United States Patent [19]

Demessemaekers et al.

[11] 4,259,373

[45] Mar. 31, 1981

[54] FABRIC TREATING ARTICLES AND PROCESS

[75] Inventors: Emiel M. Demessemaekers, Montgomery; Hans J. Pracht, Sycamore Township, Hamilton County, both of Ohio

[73] Assignee: The Procter & Gamble Company, Cincinnati, Ohio

[21] Appl. No.: 29,583

[22] Filed: Apr. 12, 1979

Related U.S. Application Data

[63] Continuation of Ser. No. 704,722, Jul. 12, 1976, abandoned.

[51] Int. Cl.[3] ..... C11D 3/395; C11D 7/54

[52] U.S. Cl. ..... 427/242; 8/137; 34/9; 34/12; 206/0.5; 206/0.84; 252/8.75; 252/8.8; 252/90; 252/91; 428/246; 428/284; 428/304; 428/311

[58] Field of Search ..... 427/242; 8/137; 34/9, 34/12, 60, 72, 133; 206/0.5, 84, 0.84; 252/8.75, 8.8, 90, 91; 428/246, 284, 304, 311

[56] References Cited

U.S. PATENT DOCUMENTS

| | | | |
|---|---|---|---|
| 3,442,692 | 5/1969 | Gaisei | 427/242 |
| 3,633,538 | 1/1972 | Hoeflin | 118/76 |
| 3,676,199 | 7/1972 | Hewitt et al. | 427/242 |
| 3,696,034 | 10/1972 | Hewitt et al. | 427/242 |
| 3,870,145 | 3/1975 | Mizuno | 206/84 |
| 3,945,936 | 3/1976 | Lucas et al. | 34/72 X |
| 3,947,971 | 4/1976 | Bauer | 427/242 X |
| 3,967,008 | 6/1976 | Mizuno et al. | 427/242 |
| 4,022,938 | 5/1977 | Zaki et al. | 427/242 |
| 4,095,946 | 6/1978 | Jones et al. | 8/137 |
| 4,105,813 | 8/1978 | Mizuno | 428/76 |
| 4,113,630 | 9/1978 | Hagner et al. | 252/8.6 |
| 4,118,525 | 10/1978 | Jones | 427/242 |
| 4,149,977 | 4/1979 | Morganson et al. | 252/8.8 |
| 4,170,565 | 10/1979 | Flesher et al. | 252/93 |

OTHER PUBLICATIONS

17911, Fabric Conditioning, Articles & Processes, Mar., 1979.

*Primary Examiner*—Michael R. Lusignan
*Attorney, Agent, or Firm*—Ronald L. Hemingway; Richard C. Witte

[57] ABSTRACT

Fabric conditioning articles comprising a double layered porous receptacle releasably containing a fabric softener/antistat composition. Methods of using the conditioning articles are also provided.

20 Claims, No Drawings

FABRIC TREATING ARTICLES AND PROCESS

This is a continuation of application Ser. No. 704,722, filed July 12, 1976, abandoned.

BACKGROUND OF THE INVENTION

The present invention relates to articles and methods for supplying softening and antistatic benefits to fabrics in an automatic clothes washer and/or dryer. The articles comprise a double layered porous receptacle releasably containing a fabric softener/antistat composition.

Treating fabrics in an automatic clothes dryer has recently been shown to be an effective means for conditioning and imparting desirable tactile properties thereto. In particular, it is becoming common to soften fabrics in an automatic clothes dryer rather than during the rinse cycle of a laundering operation. Treating fabrics in the dryer, rather than in the wash, has enabled the formulator of fabric conditioners to develop and use materials which may not be compatible with detergents when added as a powder to the wash. Moreover, the user of dryer-added conditioners is not compelled to make the special effort required with many rinse-added products.

Although dryer-added conditioners have solved some of the problems inherent in wash- or rinse-added conditioners, there still remains the need to improve performance and increase convenience. The ability to add an improved conditioning article at the start of the wash cycle would supply such benefits.

The use of fabric conditioning materials in detergent compositions or other compositions intended for use at the start of the wash cycle has long been attempted. However, as indicated above, these attempts have met with only modest success due to incompatibility of the actives with the detergent materials or inefficient attachment of the actives to the treated fabrics. The softening and antistatic performance of such prior art compositions falls short of the performance obtained from rinse cycle added or dryer cycle added compositions.

The present invention is based on the discovery that fabrics can receive softening and antistatic benefits from a porous article containing a softener/antistat composition while being treated in an automatic clothes washer and/or dryer. Superior conditioning benefits are achieved while offering significant additional convenience.

It is an object of the present invention, therefore, to provide articles which can be added to a clothes washer and/or dryer to condition fabrics in a superior manner concurrently with a washer and/or dryer operation.

It is a further object herein to provide methods for conditioning fabrics.

These and other objects will become obvious from the following disclosure.

DESCRIPTION OF THE PRIOR ART

U.S. Pat. No. 3,822,145, Liebowitz et al., FABRIC SOFTENING, issued July 2, 1974, relates to the use of spherical materials as fabric softening agents. U.S. Pat. No. 3,743,534, Zamora et al., PROCESS FOR SOFTENING FABRICS IN A DRYER, issued July 3, 1973; U.S. Pat. No. 3,698,095, Grand et al., FIBER CONDITIONING ARTICLE, issued Oct. 17, 1972; U.S. Pat. No. 3,686,025, Morton, TEXTILE SOFTENING AGENTS IMPREGNATED INTO ABSORBENT MATERIALS, issued Aug. 22, 1972; U.S. Pat. No. 3,676,199, Hewitt et al., FABRIC CONDITIONING ARTICLE AND USE THEREOF, issued July 11, 1972; U.S. Pat. No. 3,633,538, Hoeflin, SPHERICAL DEVICE FOR CONDITIONING FABRICS IN DRYER, issued Jan. 11, 1972; U.S. Pat. No. 3,624,947, Furgal, COATING APPARATUS, issued Jan. 18, 1972; U.S. Pat. No. 3,632,396, Zamora, DRYER-ADDED FABRIC-SOFTENING COMPOSITIONS, issued Jan. 4, 1972; U.S. Pat. No. 3,442,692, Gaiser, METHOD OF CONDITIONING FABRICS, issued May 6, 1969; and U.S. Pat. No. 3,947,971, Bauer, FABRIC SOFTENER AND DISPENSER, issued Apr. 6, 1976, each relate to articles and methods for conditioning fabrics in automatic dryers. U.S. Pat. No. 3,594,212, Ditsch, TREATMENT OF FIBROUS MATERIALS WITH MONTMORILLONITE CLAYS AND POLYAMINES AND POLYQUATERNARY AMMONIUM COMPOUNDS relates to the treatment of fibrous materials with clays and amine or ammonium compounds.

Granular detergent compositions containing fabric conditioning materials are disclosed in U.S. Pat. No. 3,862,058, Nirschl et al., DETERGENT COMPOSITIONS CONTAINING A SMECTITE-TYPE CLAY AND SOFTENING AGENT, issued Jan. 21, 1975, and U.S. Pat. No. 3,861,870, Edwards et al., FABRIC SOFTENING COMPOSITIONS CONTAINING WATER INSOLUBLE PARTICULATE, issued Jan. 21, 1975.

SUMMARY OF THE INVENTION

The instant invention is based on the discovery that superior fabric conditioning articles can be prepared by releasably placing an effective amount of a fabric softener/antistat composition into a closed, flexible receptacle, at least one wall of said receptacle comprising two layers having a combined air permeability of from about 200 to about 390 cubic feet per minute per square foot of surface.

In its process aspect, this invention encompasses a process for conditioning fabrics comprising combining an article of the type disclosed above with a load of fabrics in a clothes washer and leaving the article with the fabrics through the rinse cycle of the washer and the drying cycle of an automatic clothes dryer if such drying method is used. Alternatively, the article may be used only in an automatic clothes dryer and operating the dryer, with tumbling, in standard fashion. Also, alternatively, the article may remain with the fabrics through all the cycles of an automatic washer and be discarded at the end of that time if an automatic dryer is not used.

DETAILED DESCRIPTION OF THE INVENTION

The articles herein comprise multiple components each of which is described, in turn, below.

Receptacle

The receptacle which releasably holds the fabric softener/antistat composition in the present invention is a closed, flexible article having at least one porous wall comprising two layers having a combined air permeability of from about 200 to 390 cubic feet per minute per square foot of surface. The air permeability is measured according to ASTM Method D737-69, "Standard Method of Test for Air Permeability of Textile Fabrics." Inasmuch as the receptacle is to be used in an automatic clothes washer and an automatic clothes dryer, it should be comprised of a heat resistant and water insoluble material. Therefore, the receptacle herein can be made of any materials meeting these requirements. The porous wall can be made, for example, of open weave cotton, polyester, and the like, cloth or foams.

In a preferred receptacle herein, one layer associated with the porous wall or walls is an elastic, open cell foam or elastic nonwoven material. The open cell foams are distinguished from closed cell foams in that the closed cell structure substantially isolates the individual cells while the open cell structure does not.

Open cell foams can be made from polystyrene, polyurethane, polyethylene, poly-(vinyl chloride) cellulose acetate, phenolformaldehyde and other materials such as cellular rubber. Many of these materials and their method of manufacture are disclosed in standard references such as *Encyclopedia of Polymer Science and Technology,* Interscience Publishers, John Wiley & Sons, Inc. (1965), incorporated herein by reference.

The preferred nonwoven cloth materials used in the first described layer herein can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e., an array of fibers in a carded web wherein partial orientation of the fibers is frequently present, as well as a completely haphazard distributional orientation), or substantially aligned. The fibers or filaments can be natural (e.g., wool, silk, jute, hemp, cotton, linen, sisal, or ramie) or synthetic (e.g., rayon cellulose ester, polyvinyl derivatives, poly-olefins, polyamides, or polyesters). Preferred materials include polyesters, polyamides, poly-olefins and polyvinyl derivatives and mixtures of these with rayon or cotton to achieve the desired elasticity.

Methods of making nonwoven cloths are not a part of this invention and, being well known in the art, are not described in detail herein. Generally, however, such cloths are made by air- or water-laying processes in which the fibers or filaments are first cut to desired lengths from long strands, passed into a water or air stream, and then deposited onto a screen through which the fiber-laden air or water is passed. The deposited fibers or filaments are then adhesively bonded together, dried, cured, and otherwise treated as desired to form the nonwoven cloth. Nonwoven cloths made of polyesters, polyamides, vinyl resins, and other thermoplastic fibers can be span-bonded, i.e., the fibers are spun out onto a flat surface and bonded (melted) together by heat or by chemical reactions.

This first described layer serves to preserve the shape of the receptacles herein. Additionally, the layer serves to moderate the release of the softener/antistat composition. It should not be more controlling in this respect, however, than the second layer.

Especially preferred materials for preparing the above-described layer of the article herein are open pore polyurethane foams and span-bonded nonwoven cloths, especially those made from polyesters. The polyurethane foams preferably have a density of from about 0.02 g/cm$^3$ to about 0.04 g/cm$^3$ while the polyester has a density of about 0.005 g/cm$^3$ to 0.02 g/cm$^3$. The thickness of this layer can vary depending on the release characteristics desired by the manufacturer, but will preferably be from about 0.2 cm to about 2.0 cm for polyurethane and from about 0.2 cm to about 2.0 cm for polyester.

The other layer of the preferred articles herein is a moderately porous nonwoven fabric. The nonwoven fabric can be any of the above-described nonwovens which meets these requirements but will generally be polyester, polypropylene or mixtures of polyester with rayon or cotton. This other layer has a lower porosity than the first described layer and will generally be in the range of 200 to 390 cubic feet per minute per square foot of fabric. Since the first described layer should not be more controlling than this second described layer in terms of conditioner release, its air permeability should be greater than 390 cubic feet per minute per square foot of surface.

The receptacles herein provide controlled release of the softening antistat compound during the wash and rinse cycles of an automatic washing machine and, if used, in the drying cycle of an automatic clothes dryer. The double layer feature of the receptacle provides a more efficient release than a single layer receptacle while also providing a more aesthetically pleasing article throughout the entire usage cycles.

Additionally, the double layered feature helps to insure that fabric staining is minimized by preventing a large amount of the softener/antistat composition to be released at one time.

The ideal fabric softener/antistat composition release pattern is one where the release is minimized during the wash cycle and the majority of the composition is released in the rinse cycle and dryer cycle. The articles herein provide such a release pattern.

In a preferred article herein the inner layer of the receptacle is the first layer described above and is constructed of span-bonded polyester or polyurethane foam having an air permeability in excess of about 390 cubic feet per minute per square foot of surface. The outer layer in the preferred article is a nonwoven polyester having an air permeability of from about 200 to about 390 cubic feet per minute per square foot of surface. The article in this preferred embodiment takes the form of a pouch.

Fabric Softener/Antistat Composition

The fabric softener/antistat composition employed herein can contain any of the wide variety of nonionic and cationic materials known to supply these benefits. These materials are substantive, and have a melting point within the range of from about 20° C. to about 115° C., preferably within the range of from about 30° C. to about 60° C. By "substantially water insoluble" herein is meant a water insolubility of 1% by weight, or less, at 30° C. These materials are generally nonionic or cationic and are described in more detail hereinbelow.

The most common type of cationic softener/antistat materials are the cationic nitrogen-containing compounds such as quaternary ammonium compounds and amines having one or two straight-chain organic groups of at least eight carbon atoms. Preferably, they have one or two such groups of from 12 to 22 carbon atoms. Preferred cation-active softener compounds include the quaternary ammonium softener/antistat compounds corresponding to the formula

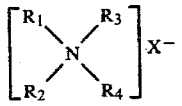

wherein $R_1$ is hydrogen or an aliphatic group of from 1 to 22 carbon atoms; $R_2$ is an aliphatic group having from 12 to 22 carbon atoms; $R_3$ and $R_4$ are each alkyl groups of from 1 to 3 carbon atoms; and X is an anion selected from halogen, acetate, phosphate, nitrate and methyl sulfate radicals.

Because of their excellent softening efficacy and ready availability, preferred cationic softener/antistat compounds of the invention are the dialkyl dimethyl ammonium chlorides, wherein the alkyl groups have from 12 to 22 carbon atoms and are derived from long-chain fatty acids, such as hydrogenated tallow. As employed herein, alkyl is intended as including unsaturated compounds such as are present in alkyl groups derived from naturally occurring fatty oils. The term "tallow" refers to fatty alkyl groups derived from tallow fatty acids. Such fatty acids give rise to quaternary softener compounds wherein $R_1$ and $R_2$ have predominantly from 16 to 18 carbon atoms. The term "coconut" refers to fatty acid groups from coconut oil fatty acids. The coconut-alkyl $R_1$ and $R_2$ groups have from about 8 to about 18 carbon atoms and predominate in $C_{12}$ to $C_{14}$ alkyl groups. Representative examples of quaternary softeners of the invention include tallow trimethyl ammonium chloride; ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; dihexadecyl dimethyl ammonium acetate; ditallow dipropyl ammonium phosphate; ditallow dimethyl ammonium nitrate; di(coconut-alkyl) dimethyl ammonium chloride.

An especially preferred class of quaternary ammonium softener/antistats of the invention correspond to the formula

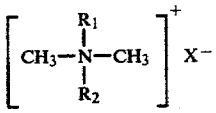

wherein $R_1$ and $R_2$ are each straight chain aliphatic groups of from 12 to 22 carbon atoms and X is halogen, e.g., chloride or methyl sulfate. Especially preferred are ditallow dimethyl ammonium methyl sulfate (or chloride) and di(hydrogenated tallow-alkyl) dimethyl ammonium methyl sulfate (or chloride) and di(coconut-alkyl) dimethyl ammonium methyl sulfate (or chloride), these compounds being preferred from the standpoint of excellent softening properties and ready availability.

Suitable cation-active amine softener/antistat compounds are the primary, secondary and tertiary amine compounds having at least one straight-chain organic group of from 12 to 22 carbon atoms and 1,3-propylene diamine compounds having a straight-chain organic group of from 12 to 22 carbon atoms. Examples of such softener actives include primary tallow amine; primary hydrogenated-tallow amine; tallow 1,3-propylene diamine; oleyl 1,3-propylene diamine; coconut 1,3-propylene diamine; soya 1,3-propylene diamine and the like.

Other suitable cation-active softener/antistat compounds herein are the quaternary imidazolinium salts. Preferred salts are those conforming to the formula

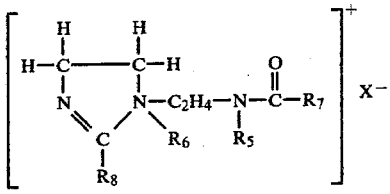

wherein $R_6$ is an alkyl containing from 1 to 4, preferably from 1 to 2 carbon atoms, $R_5$ is an alkyl containing from 1 to 4 carbon atoms or a hydrogen radical, $R_8$ is an alkyl containing from 1 to 22, preferably at least 15 carbon atoms or a hydrogen radical, $R_7$ is an alkyl containing from 8 to 22, preferably at least 15 carbon atoms, and X is an anion, preferably methylsulfate or chloride ions. Other suitable anions include those disclosed with reference to the cationic quaternary ammonium fabric softener/antistats described hereinbefore. Particularly preferred are those imidazolinium compounds in which both $R_7$ and $R_8$ are alkyls of from 12 to 22 carbon atoms, e.g., 1-methyl-1-[(stearoylamide)ethyl]-2-heptadecyl-4,5-dihydroimidazolinium methyl sulfate; 1-methyl-1-[(palmitoylamide)ethyl]-2-octadecyl-4,5-dihydroimidazolinium chloride and 1-methyl-1-[(tallowamide)ethyl]-2-tallow-imidazolinium methyl sulfate.

Other cationic quaternary ammonium fabric softener/antistats which are useful herein include, for example, alkyl ($C_{12}$ to $C_{22}$)-pyridinium chlorides, alkyl $C_{12}$ to $C_{22}$)-alkyl ($C_1$ to $C_3$)-morpholinium chorides, and quaternary derivatives of amino acids and amino esters.

Nonionic fabric softener/antistat materials include a wide variety of materials including sorbitan esters, fatty alcohols and their derivatives, diamine compounds and the like. One preferred type of nonionic fabric antistat/-softener material comprises the esterified cyclic dehydration products of sorbitol, i.e., sorbitan ester. Sorbitol, itself prepared by catalytic hydrogenation of glucose, can be dehydrated in well-known fashion to form mixtures of cyclic 1,4- and 1,5-sorbitol anhydrides and small amounts of isosorbides. (See Brown; U.S. Pat. No. 2,322,821; issued June 29, 1943). The resulting complex mixtures of cyclic anhydrides of sorbitol are collectively referred to herein as "sorbitan". It will be recognized that this "sorbitan" mixture will also contain some free uncyclized sorbitol.

Sorbitan ester fabric softener/antistat materials useful herein are prepared by esterifying the "sorbitan" mixture with a fatty acyl group in standard fashion, e.g., by reaction with a fatty ($C_{10}$–$C_{24}$) acid or fatty acid halide. The esterification reaction can occur at any of the available hydroxyl groups, and various mono-, di-, etc., esters can be prepared. In fact, complex mixtures of mon-, di-, tri-, and tetra-esters almost always result from such reactions, and the stoichiometric ratios of the reactants can simply be adjusted to favor the desired reaction product.

The foregoing complex mixtures of esterified cyclic dehydration products of sorbitol (and small amounts of esterified sorbitol) are collectively referred to herein as "sorbitan esters". Sorbitan mono- and di-esters of lauric, myristic, palmitic, stearic and behenic acids are particularly useful herein for conditioning the fabrics being treated. Mixed sorbitan esters, e.g., mixtures of the foregoing esters, and mixtures prepared by esterifying sorbitan with fatty acid mixtures such as the mixed tallow and hydrogenated palm oil fatty acids, are useful herein and are economically attractive. Unsaturated $C_{10}$–$C_{18}$ sorbitan esters, e.g., sorbitan mono-oleate, usually are present in such mixtures. It is to be recognized that all sorbitan esters, and mixtures thereof, which are essentially water-insoluble and which have fatty hydrocarbyl "tails", are useful fabric softener/antistat materials in the context of the present invention.

The preferred alkyl sorbitan ester fabric softener/antistat materials herein comprise sorbitan monolaurate, sorbitan monomyristate, sorbitan monopalmitate, sorbitan monostearate, sorbitan monobehenate, sorbitan dilaurate, sorbitan dimyristate, sorbitan dipalmitate, sorbitan distearate, sorbitan dibehenate, and mixtures thereof, the mixed coconutalkyl sorbitan mono-and di-esters and the mixed tallowalkyl sorbitan mono- and di-esters. The tri- and tetra-esters of sorbitan with lauric, myristic, palmitic, stearic and behenic acids, and mixtures thereof, are also useful herein.

Another useful type of nonionic fabric softener/antistat material encompasses the substantially water-insoluble compounds chemically classified as fatty alcohols. Mono-ols, di-ols, and poly-ols having the requisite melting points and water-insolubility properties set forth above are useful herein. Such alcohol-type fabric conditioning materials also include the mono- and di-fatty glycerides which contain at least one "free" OH group.

All manner of water-insoluble, high melting alcohols (including mono- and di-glycerides), are useful herein, inasmuch as all such materials are fabric substantive. Of course, it is desirable to use those materials which are colorless, so as not to alter the color of the fabrics being treated. Toxicologically acceptable materials which are safe for use in contact with skin should be chosen.

A preferred type of unesterified alcohol useful herein includes the higher melting members of the so-called fatty alcohol class. Although once limited to alcohols obtained from natural fats and oils, the term "fatty alcohols" has come to mean those alcohols which correspond to the alcohols obtainable from fats and oils, and all such alcohols can be made by synthetic processes. Fatty alcohols prepared by the mild oxidation of petroleum products are useful herein.

Another type of material which can be classified as an alcohol and which can be employed as the fabric softener/antistat material in the instant invention encompasses various esters of polyhydric alcohols. Such "ester-alcohol" materials which have a melting point within the range recited herein and which are substantially water-insoluble can be employed herein when they contain at least one free hydroxyl group, i.e., when they can be classified chemically as alcohols.

The alcoholic di-esters of glycerol useful herein include both the 1,3-di-glycerides and the 1,2-di-glycerides. In particular, di-glycerides containing two $C_8$–$C_{20}$, preferably $C_{10}$–$C_{18}$, alkyl groups in the molecule are useful fabric conditioning agents.

Non-limiting examples of ester-alcohols useful herein include: glycerol-1,2-dilaurate; glycerol-1,3-dilaurate; glycerol-1,2-dimyristate; glycerol-1,3-dimyristate; glycerol-1,2-dipalmitate; glycerol-1,3-dipalmitate; glycerol-1,2-distearate and glycerol-1,3-distearate. Mixed glycerides available from mixed tallowalkyl fatty acids, i.e., 1,2-ditallowalkyl glycerol and 1,3-ditallowalkyl glycerol, are economically attractive for use herein. The foregoing ester-alcohols are preferred for use herein due to their ready availability from natural fats and oils.

Mono- and di-ether alcohols, especially the $C_{10}$–$C_{18}$ di-ether alcohols having at least one free -OH group, also fall within the definition of alcohols useful as fabric softener/antistat materials herein. The ether-alcohols can be prepared by the classic Williamson ether synthesis. As with the ester-alcohols, the reaction conditions are chosen such that at least one free, unetherified -OH group remains in the molecule.

Ether-alcohols useful herein include glycerol-1,2-dilauryl ether; glycerol-1,3-distearyl ether; and butane tetra-ol-1,2,3-trioctanyl ether.

Yet another type of nonionic fabric conditioning agent useful herein encompasses the substantially water-insoluble (or dispersible) diamine compounds and diamine derivatives. The diamine fabric conditioning agents are selected from the group consisting of particular alkylated or acylated diamine compounds.

Useful diamine compounds have the general formula $$R_1-\overset{\overset{R_2}{|}}{N}-(CH_2)_n-\overset{\overset{R_3}{|}}{N}-R_4$$

wherein $R_1$ is an alkyl or acyl group containing from about 12 to 20 carbon atoms; $R_2$ and $R_3$ are hydrogen or alkyl of from about 1 to 20 carbon atoms and $R_4$ is hydrogen, $C_{1-20}$ alkyl or $C_{12-20}$ acyl. At least two of $R_2$, $R_3$ and $R_4$ are hydrogen or alkyl containing 1 to 3 carbon atoms, and n is from 2 to 6.

Non-limiting examples of such alkylated diamine compounds include:

$C_{15}H_{33}$—$N(CH_3)$—$(CH_2)_3$—$N(CH_3)_2$
$C_{18}H_{37}$—$N(CH_3)$—$(CH_2)_2$—$N(C_2H_5)_2$
$C_{12}H_{25}$—$N(CH_3)$—$(CH_2)_3$—HN—$C_{12}H_{25}$
$C_{12}H_{25}$—$N(C_2H_5)$—$(CH_2)_3$—$N(C_3H_7)_2$
$R_{\overline{Tallow}}$ NH—$(CH_2)_3$—$N(C_2H_5)_2$
$C_{20}H_{41}$—$N(CH_3)$—$(CH_2)_2$—$N(CH_3)_2$
$C_{15}H_{31}$—$N(C_2H_5)$—$(CH_2)_3$—$NH_2$
$C_{18}H_{37}$—NH—$(CH_2)_3$—HN—$CH_3$
$C_{16}H_{33}$—NH—$(CH_2)_3$—HN—$C_{16}H_{33}$
$R_{\overline{Tallow}}$ $N(CH_3)$—$(CH_2)_3$—$N(C_2H_5)_2$
$C_{16}H_{33}N(CH_3)$—$(CH_2)_5$—$N(C_2H_5)_2$
$C_{12}H_{25}N(C_2H_5)$—$(CH_2)_2$—$N(C_3H_7)_2$ and
$C_{14}H_{29}N(CH_3)$—$(CH_2)_3$—$(CH_3)N$—$C_8H_{17}$ wherein in the above formulas $R_{Tallow}$ is the alkyl group derived from tallow fatty acid.

Other examples of suitable aklyated diamine compounds include N-tetradecyl, N'-propyl-1,3-propanediamine, N-eicosyl,N,N',N'-triethyl-1,2-ethane-diamine and N-octadecyl,N,N',N'-tripropyl-1,3-propane-diamine.

Examples of suitable acylated diamine fabric softener/antistat materials include $C_{13-20}$ amido amine derivatives.

The fabric softener/antistats mentioned above can be used singly or in combination in the practice of the present invention.

Preferred mixtures useful herein are mixtures of dialkyl dimethyl ammonium salts with imidazolinium salts and mixtures of these two materials with sorbitan esters. An especially preferred mixture includes ditallow dimethyl ammonium methyl sulfate, 1-methyl-1-[(tallowamide)ethyl]-2-tallow imidazolinium methyl sulfate and sorbitan tristearate in a ratio of from about 65/35/0 to 10/55/35. Tallow alcohol or hydrogenated castor oil may be used to replace sorbitan tristearate in the above mixture with similar results being obtained. Another especially preferred mixture includes the above mixture wherein the sorbitan tristearate is absent and the other two components are present in a ratio of from about 65:35 to 35:65.

Optional Components

In a preferred article herein the softener/antistat composition is in the form of a free flowing powder. To facilitate forming such a powder any of a wide variety of filler materials may be used in the present composition. Such fillers include inorganics such as sodium sulfate, calcium carbonate, aluminum oxide and smectite clays and organics such as high molecular weight polyethylene glycols. Smectite clays and aluminum oxide are preferred fillers herein. A description of smectite clays may be found in U.S. Pat. No. 3,862,058, Jan. 21, 1975, to Nirschl et al., incorporated herein by reference. The filler material may be present at a level ranging from about 5% to 35% by weight of the softener/antistat composition.

The fabric softening/antistat compositions herein can also optionally contain minor proportions (i.e., 0.1% to about 15% by weight of various other ingredients which provide additional fabric conditioning benefits. Such optional ingredients include perfumes, bleaches, fumigants, bactericides, fungicides, optical brighteners and the like. Specific examples of typical solid, water-soluble additives useful herein can be found in any current Year Book of the American Association of Textile Chemists and Colorists. Such additional components can be selected from those compounds which are known to be compatible with the softener/antistat agents employed herein, or can be coated with water-soluble coatings such as solid soaps, and the like, and thereby rendered compatible.

A preferred optional ingredient is a fabric substantive perfume having a melting point greater than 100° F. Included among such perfume materials are musk ambrette, musk ketone, musk xylol, ethyl vanillin, musk tibetine, coumarin, aurantiol and mixtures thereof. These perfumes can either be added alone to the softener or be encapsulated with a polyvinyl acetate/sodium alginate mixture. The above perfumes are preferably used in an amount of from about 0.1% to about 5% by weight of the fabric softener/antistat composition.

Other useful optional ingredients herein include the common inorganic peroxy compounds such as alkali metal and ammonium perborates, percarbonates, monopersulfates and monoperphosphates. Solid, water-soluble organic peroxy acids, or the water-soluble, e.g., alkali metal, salts thereof of the general formula $$HO-O-\overset{\overset{\displaystyle O}{\|}}{C}-YH$$

wherein R is a substituted or unsubstituted alkylene or arylene group and Y is $$-\overset{\overset{\displaystyle O}{\|}}{C}-O-O-,\ -\underset{\underset{\displaystyle O}{\|}}{\overset{\overset{\displaystyle O}{\|}}{S}}-O \text{ or } O-\overset{\overset{\displaystyle O}{\|}}{C}-O-O-$$

or any other group which yields an anionic group in aqueous solution are also useful herein. These bleaches are more fully described in U.S. Pat. No. 3,749,673, July 31, 1973, Jones et al., incorporated herein by reference.

The water-soluble silicate materials recognized in the art as corrosion inhibitors can be employed in the present compositions at levels of about 5% by weight.

Release aids in the form of electrolytes (e.g., $CaCl_2$) or nonionic surfactants can also be advantageously employed in the present invention.

It will be recognized that any of the foregoing types of optional components can be provided in a solid, particulate form which can be dispensed onto the fabrics concurrently with the fabric softener/antistat to provide the desired additional fabric treatment benefits.

Preparation and Usage

The articles of the present invention are prepared by fashioning a receptable of the type hereinbefore described and enclosing therein an effective amount of the fabric softener/antistat composition. By an "effective amount" of the fabric softener/antistat composition herein is meant an amount sufficient to condition an average load of fabrics in an automatic washer/dryer. Of course, the actual amount of the softener/antistat composition employed will depend on the fabric load and the softener/antistat composition selected for use in the article. For an average 5 lbs. to 8 lbs. load of fabrics, from about 4 grams to 12 grams of any of the foregoing softener/antistat compositions provide good fabric conditioning.

When preparing the articles herein the rate of release of the softener/antistat composition from the receptacle is preferably optimized. The rate of release should be controlled such that the majority of the release takes place in the rinse cycle of the washer and the dryer cycle. The rate of release of the composition depends on the porosity of the layered walls and the physical characteristics of the softener/antistat composition. The composition can take the form of a solid or more preferably a free flowing granular composition. In its solid form the softener/antistat composition is suitable for use primarily in the washing cycle of the automatic washer since the composition will be exposed to large amounts of water. On the other hand, the preferred granular form is suitable for use in either the washing cycle of the automatic washer or the drying cycle of the automatic dryer. The granules will be of a slightly smaller size than the openings in the outer layer of the receptacle herein. Softener/antistat compositions having an average diameter below about 150 microns and preferably falling in the range of from about 40 microns to about 120 microns are preferred for use herein. Particles of such size readily melt on the fabrics when they are either released in the dryer or carried with the fabrics into the dryer when they are released earlier, as in the rinse cycle.

The receptacle herein can be provided in a variety of sizes and shapes and the particular configuration of the receptacle is not critical to the practice of this invention. For example, the receptacle herein can be provided wherein only one wall, or a portion of one wall, comprises the double-layered porous opening through which the fabric softener/antistat composition is dispensed. Preferably the whole of the receptacle can comprise a double-layered porous material.

In its simplest and preferred aspect, the receptacle herein is prepared in the shape of a pouch. Preferred receptacles herein comprise an inner layer of a polyurethane foam having a density of from about 0.02 g/cm$^3$ to about 0.04 g/cm$^3$ or a span-bonded polyester nonwoven fabric having a density of from about 0.005 to 0.02 g/cm$^3$, the air permeability of said layer being in excess of 390 cubic feet per minute per square foot of surface. The outer layer in the preferred receptacles herein comprises a nonwoven polyester cloth having an air permeability of from about 200 to about 390 cubic feet per minute per square foot. The pouch is formed by sealing three edges of the two layers, as by heat sealing, leaving an opening along one edge. The fabric softener/antistat composition is added to the pouch opening which is then sealed.

Usage

The articles of the present invention can be utilized in a variety of ways depending on the desires of the user. In a preferred process, an article prepared as described herein is placed in with a load of fabrics at the start of the wash cycle in a standard clothes washer and left with the fabrics through the entire wash, rinse and spin drying cycles. The temperature of the wash and rinse waters can be any temperatures desired by the user, but generally are in the range of from about 4° C. to about 60° C. The article then remains with the damp fabrics when they are placed in the drum of an automatic clothes dryer, if a dryer is used. The dryer is operated in standard fashion to dry the fabrics, usually at a temperature from about 50° C. to about 80° C. for a period of from about 10 to about 60 minutes, depending on the fabric load and type. Alternatively, the articles herein can be combined with the fabrics at either the start of the rinse cycle or at the start of the automatic dryer cycle. The use of the article at the start of the wash cycle is preferred since the article during such usage is able to impart to the fabrics both excellent softness and reduction in static.

The detergent composition which can be used to wash the fabrics during the above-described wash cycle can be any conventional detergent composition. Such a composition generally contains from about 1% to about 50% of a detersive surfactant. The detergents may be liquid or solid and contain other components such as a detergency builder, bleaches, enzymes, among other detergency adjuvants. The surfactants which may be used include any of the common anionic, nonionic, ampholytic and zwitterionic detersive agents well known in the detergency arts. Mixtures of surfactants may also be used. Examples of surfactants are given in U.S. Pat. No. 3,717,630, Booth, Feb. 20, 1973, and U.S. Pat. No. 4,443,880, Kessler et al., July 25, 1967, each incorporated herein by reference.

The detergency builder salts which are oftentimes utilized in detergent compositions include both inorganic, as well as organic, water-soluble builder salts and the various water-insoluble and so-called "seeded" builders. Typical laundry detergent compositions are designed to provide a concentration of builder salt of from about 50 ppm to about 1000 ppm and a concentration of detersive surfactant in the range of 50 ppm to about 1000 ppm. These concentrations are generally met in the average aqueous solutions used to wash fabrics (5–25 gallons). The amount of detergent composition utilized per wash load is familiar to users of laundry products and ranges from about ¼ cup to 1¼ cup.

The performance delivered by the receptacles herein when used as described above is equivalent to a rinse added liquid softener in terms of softness and a dryer added sheet in terms of static control.

The invention will be further illustrated by the following examples:

EXAMPLE I

A pouch of the present invention is made in the following manner:

A. Four layers measuring approximately 7½ cm by 9 cm are placed one atop the other in the following order:

1. A layer of nonwoven polyester approximately 0.33 mm thick and having an air permeability of approximately 350 cubic feet per minute per square foot of surface. (SONTARA 8000, E. I. duPont Co.)
2. A layer of nonwoven polyester approximately 5 mm thick and having an air permeability of greater than 500 cubic feet per minute per square foot of surface ("Bond Air," J. P. Stevens Co.)
3. Same as 2 above.
4. Same as 1 above.

B. The four layer stack from A is heat sealed on three sides forming a rectangular pouch with one open end.

C. Twelve grams of the following fabric softener/antistat composition is filled into the pouch between layers 2 and 3:

| | |
|---|---|
| Ditallow dimethyl ammonium methyl sulfate (90% Active) | 34.2% |
| 1-Methyl-1-[(tallowamide)ethyl]-2-tallow imidazolinium methyl sulfate (70% Active) | 22.8 |
| Sorbitan tristearate | 25.0 |
| Smectite clay (Gelwhite GP, Georgia Kaolin Co.) | 15.0 |
| Perfume | 3.0 |
| | 100.0% |

The above composition is made as shown in Example II.

EXAMPLE II

The granular softener/antistat composition used in Example I is made in the following manner:

A. The ditallow dimethyl ammonium methyl sulfate, the imidazolinium salt and the sorbitan tristearate are comelted together at 190° F.

B. The clay and perfume are premixed.

C. The mixture of A is sprayed through a fine nozzle and solidifies into a powder containing particles ranging in size from about 5 to 150 microns. During the spraying the mixture of B is evenly admixed into the sprayed composition.

EXAMPLE III

The pouch of Example I is added along with a 5.5 lb. bundle of soiled fabrics and 69 grams of an anionic detergent to an automatic washer. The washer is operated for a period of 15 minutes using 100° F. temperature water. After the completion of the wash cycle, the rinse and spin dry cycles are completed. Finally, the fabrics and the pouch are transferred to an automatic clothes dryer which is operated for a period of 50 minutes at a normal temperature setting. The dried fabrics demonstrate excellent softness and static control.

What is claimed is:

1. A fabric conditioning article especially designed for conditioning fabrics in an automatic washer comprising:

(A) a closed, water-insoluble, heat resistant flexible receptacle, at least one wall of said receptacle comprising two layers having a combined air permeability of from about 200 to about 390 cubic feet per minute per square foot of surface; and (B) an effective amount of a fabric softener/antistat composition, said composition being releasably enclosed within the receptacle.

2. An article according to claim 1 wherein one of the two layers is selected from the group consisting of open cell foams and elastic nonwoven materials and the other layer is a nonwoven material.

3. An article according to claim 2 wherein the fabric softener/antistat composition contains a mixture of cationic and nonionic softener/antistat materials.

4. An article according to claim 3 wherein the receptacle is in the form of a pouch.

5. An article according to claim 4 wherein both walls of the pouch are constructed of the two layers having a combined air permeability of from about 200 to about 390 cubic feet per square foot of surface.

6. An article according to claim 5 wherein one layer of the pouch walls is selected from the group consisting of polyurethane foams and polyester materials, said layer having an air permeability in excess of about 390 cubic feet per minute per square foot of surface and the other layer is a polyester material having an air permeability of from about 200 to about 390 cubic feet per minute per square foot of surface.

7. An article according to claim 6 wherein the layer having the higher air permeability is the inside layer and the layer having the lower air permeability is the outside layer.

8. An article according to claim 7 wherein the fabric softener/antistat composition contains a mixture of ditallow dimethyl ammonium methyl sulfate and 1-methyl-1-[(tallowamide) ethyl]-2-tallow imidazolinium methyl sulfate in a ratio of from about 65:35 to about 35:65.

9. An article according to claim 7 wherein the fabric softener/antistat composition contains a mixture of ditallow dimethyl ammonium methyl sulfate, 1-methyl-1-[(tallowamide) ethyl]-2-tallow imidazolinium methyl sulfate and sorbitan tristearate in a ratio of from about 65:35:0 to about 10:55:35.

10. An article according to claim 9 wherein the fabric softener/antistat composition is in the form of a free flowing powder and additionally contains from about 5% to about 35% by weight of the softener/antistat composition of a filler material.

11. An article according to claim 10 wherein the filler material is selected from the group consisting of smectite clay and aluminum oxide.

12. An article according to claim 4 wherein the fabric softener/antistat composition contains from about 0.1% to about 5% by weight of said composition of a fabric substantive perfume having a melting point greater than 100° F.

13. A process for conditioning fabrics comprising the following steps:

(A) Adding to a clothes washer, containing fabrics and a normal amount of a detergent, a fabric conditioning article comprising:

(1) a closed, water-insoluble, heat resistant flexible receptacle, at least one wall of said receptacle comprising two layers having a combined air permeability of from about 200 to 390 cubic feet per minute per square foot of surface;

(2) an effective amount of a fabric softener/antistat composition, said composition being releasably enclosed within said receptacle; and (B) operating said washer at normal operating conditions through the wash, rinse and spin dry cycles.

14. A process according to claim 13 wherein the following steps are added:

(C) The washed fabrics and fabric conditioning article from step B are transferred to a clothes dryer; and (D) said dryer is operated for an effective period of time at dryer operating conditions.

15. A process according to claim 14 wherein one of the two layers is selected from the group consisting of open cell foams and elastic nonwoven materials and the other layer is a nonwoven material.

16. A process according to claim 15 wherein the fabric softener/antistat composition contains a mixture of cationic and nonionic softener/antistat materials.

17. A process according to claim 16 wherein the receptacle is in the form of a pouch.

18. A process according to claim 17 wherein both walls of the pouch are constructed of the two layers having a combined air permeability of from 200 to about 390 cubic feet per minute per square foot of surface.

19. A process according to claim 18 wherein one layer of the pouch walls is selected from the group consisting of polyurethane foams and polyester materials, said layer having an air permeability in excess of about 390 cubic feet per minute per square foot of surface and the other layer is a polyester material having an air permeability of from about 200 to about 390 cubic feet per minute per square foot of surface.

20. A process according to claim 19 wherein the layer having the higher permeability is the inside layer and the layer having the lower air permeability is the outside layer.

* * * * *